US008047397B2

(12) United States Patent
Mittet

(10) Patent No.: US 8,047,397 B2
(45) Date of Patent: Nov. 1, 2011

(54) STORAGE CONTAINER HOLDER

(76) Inventor: Theodore Mittet, Seattle, WA (US)

( * ) Notice: Subject to any disclaimer, the term of this patent is extended or adjusted under 35 U.S.C. 154(b) by 394 days.

(21) Appl. No.: 12/245,822

(22) Filed: Oct. 6, 2008

(65) Prior Publication Data

US 2010/0084415 A1 Apr. 8, 2010

(51) Int. Cl.
*B65D 25/00* (2006.01)
*B65D 45/16* (2006.01)
*A47F 5/08* (2006.01)

(52) U.S. Cl. ..... 220/751; 220/326; 312/246

(58) Field of Classification Search ..... 220/326, 220/480, 481, 751, 784, 786, 799, 324; 312/245, 312/246; 211/13.1, 126.1, 126.7; 248/146, 248/311.2, 311.7
See application file for complete search history.

(56) References Cited

U.S. PATENT DOCUMENTS 2,275,703 A 3/1942 Trester et al.
4,597,616 A 7/1986 Trubiano
4,653,818 A * 3/1987 DeBruyn ..... 312/246
4,700,849 A 10/1987 Wagner
5,273,354 A 12/1993 Herrmann et al.
5,577,823 A 11/1996 Maglinger
2004/0084464 A1* 5/2004 Koo ..... 220/784
* cited by examiner

*Primary Examiner* — Harry Grosso
(74) *Attorney, Agent, or Firm* — Joseph E. Funk

(57) ABSTRACT

A holder for to hold storage container(s) therein is disclosed. Each storage container has a lid with locking tabs or locking extension that hook underneath a protrusion around and near the top edge of the container to lock the lid to the container. The holder has a top with two downwardly extending sides with L-shaped extensions furthest from the top that create a ledge. The holder is attached to a surface. One or more containers with a lid locked thereto using the locking tabs or locking extensions are inserted into the holder and the underside of the locking tabs or locking extensions sit on the L-shaped extensions to support the container within the holder. There may be an interference fit between the container (s) with locked lid and the two downwardly extending sides that helps retain the container(s) within the holder and guarantees that two of the locking tabs are held in their locked position. A holder may have a rear overhang which only permits container(s) to be inserted into and removed from one end of the holder, otherwise they can be inserted into and removed from both ends. In alternative embodiments of the container(s) and holder there is a locking means that will not permit container(s) to be inserted into or removed from the holder until the locking means is deactivated; and a holder may hold one, two or more storage containers.

5 Claims, 7 Drawing Sheets

STORAGE CONTAINER HOLDER

FIELD OF THE INVENTION

The present invention relates to storage container(s) and holders for same, and particularly to storage containers that may be placed in a holder that is attached under or on a surface. The holder securely holds storage container(s) mounted therein and prevents it/them from inadvertently opening or sliding out of the holder.

BACKGROUND OF THE INVENTION

In the prior art there are examples of storage containers that may be in the form of a drawer or container that is suspended by a mounting system under a generally horizontal surface, and the drawer or container is slid out of the mounting system for access to the interior of the drawer.

One such mounting system and container is seen in U.S. Pat. No. 5,577,823 to H. E. Blood entitled "Water Reservoir". This patent discloses a water container that is suspended in and held by a mounting arrangement or hanging shelf that is mounted under a shelf that supports a drip pan or tray. There is nothing that restricts the removal of the water container or that prevents the container from being opened.

Another such mounting system and container is seen in U.S. Pat. No. 2,275,703 to C. P. Trester et al entitled Dispensing Container. This patent discloses dispensing containers that are suspended by guide members mounted on the underside of a bar, counter or shelf. There is nothing that restricts the removal of the dispensing container or that prevents the container from being opened.

Yet another such mounting system and container is seen in U.S. Pat. No. 4,597,616 to A. Trubiano and entitled "Drawer-Like Container System". This patent discloses a support assembly on the underside of a refrigerator shelf that suspends a drawer that may be slid into and out of the support assembly. There is nothing that restricts the removal of the shelf or that prevents the drawer from being opened.

Still another such mounting system and container is seen in U.S. Pat. No. 4,700,849 to L. Wagner and entitled "Combination Wine Rack and Glass Retention Assembly/Dispensing Assembly". This patent discloses a main housing that is fastened under a shelf or other horizontal surface. The housing has holes through its front surface into each of which a user inserts a bottle of wine. There is nothing that restricts the removal of a bottle of wine except for the shape of the bottle, and there is nothing that prevents a bottle or wine from being opened while being held in the housing.

U.S. Pat. No. 5,273,354 to R. Herrmann et al and entitled "Molded Refrigerator Shelf and Support Bracket" discloses a shelf that has add on or integral support brackets that have slide tracks for slidably receiving and supporting a storage bin or drawer beneath the shelf. There is nothing that restricts the removal of a storage bin or drawer and there is nothing that prevents inadvertent removal of a lid on a storage bin while being held by the support brackets.

U.S. Pat. No. 5,577,823 to F. Maglinger and entitled "Lazy Susan Type Pan/Carriage Assembly" discloses a pan that is rotatably supported by a carriage that is attached to the underside of a shelf. There is nothing that restricts the removal of the rotatable pan and there is nothing that prevents inadvertent removal of a lid on the rotatable pan.

Thus, there is a need in the art for a storage container and holder for same that can be mounted to a surface having any orientation. The holder can be mounted on a vertical or sloped surface, or on the top or underside of a shelf or other horizontal surface. The storage container has a lid that locks to the top of the storage container and the combination of the container and lid is slid into the holder where it is firmly held while force is applied to hold the lid locked to the top of the storage container.

SUMMARY OF THE INVENTION

The aforementioned need in the prior art is met by the present invention. A storage container has a lid with plural peripheral locking tabs around its sides that permit the lid to be placed on and then locked to the normally open top of a storage container to seal the container and keep the lid from being inadvertently removed. This can keep contents of certain containers in a water tight, air tight, dustproof environment, while other containers may not have all these attributes.

The invention has a holder that is fastened to the underside or top of a shelf or other horizontal surface, or to a surface that is vertical or sloped. The holder is used to receive and hold a sealed storage container therein and prevent the container from inadvertently being removed there from or opened. When a sealed storage container is manually inserted into and is held within the holder the system applies a force to locking tabs to both help prevent the lid from being inadvertently removed from the storage container and to help retain the sealed storage container within the holder.

Around the underside of the lid is a groove with a flexible seal therein. The groove matches the shape of the top edge of the storage container. When the lid is placed on the storage container its top edge sits in the groove against the flexible seal. As the locking tabs are manually engaged the lid is pressed firmly downward against the top edge of the container. The seal deforms slightly in the process and assures a watertight, airtight, dustproof seal of the lid to the container. In other variations of the container lid there may be no seal.

A sealed storage container is slid into a holder which may hold and retain one or more containers, and may have a locking mechanism that prevents containers from inadvertently being removed from a holder. The holder may also be of a universal design that is easily adapted during mounting to a surface to hold storage containers of any one particular size.

Each sealed storage container is manually removed from the holder by applying force to pull it there from. In the case when a locking mechanism is provided the locking mechanism must first be released to manually remove the container from the holder. The locking tabs on the container(s) may then be manually disengaged to open the container(s).

DESCRIPTION OF THE DRAWING

The invention will be better understood upon reading the following Detailed Description in conjunction with the drawings in which:

FIG. 11 is a side view of a holder with a sealed storage container inserted into and firmly held therein; and.

DETAILED DESCRIPTION

The invention as disclosed herein is a first embodiment of the novel storage container, lid and holder and three alternative embodiments. The dimensions, shape and other details of the holders, lids and storage containers may vary without departing from the teaching of the invention. For example, the number of locking tabs may vary and how the holder is attached to the underside of a shelf or other horizontal surface may vary. In addition, the lids, storage containers and holder of the present invention may be mounted to a sloped or vertical surface. In the following description reference is often made to a single container. However, it should be noted that a holder may hold more than one container and the word containers is applicable.

Figure 8:
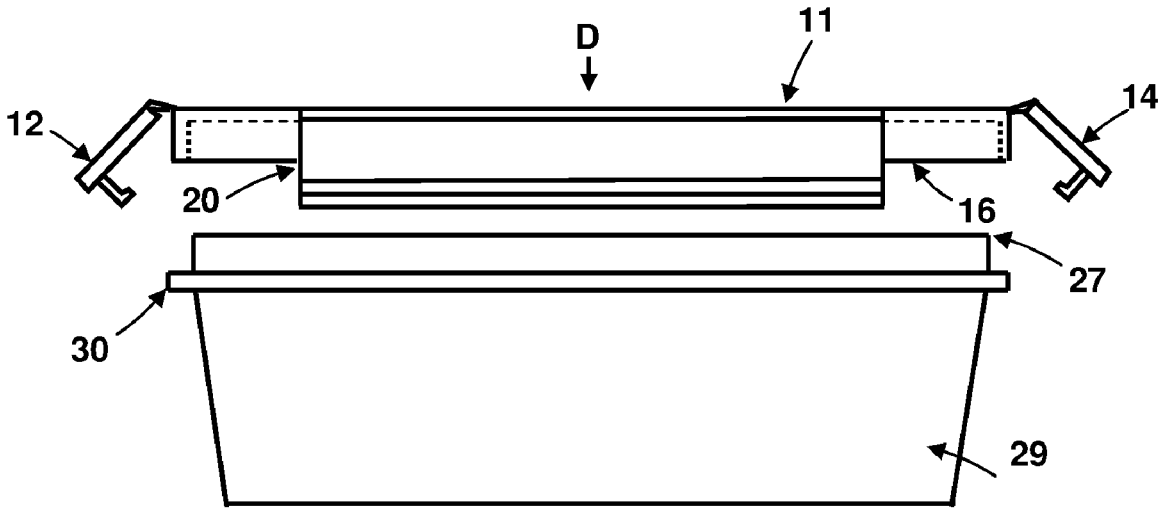
FIG. 8 is a front view of a storage container with a lid being placed thereon but not locked thereto.
Figure 9:
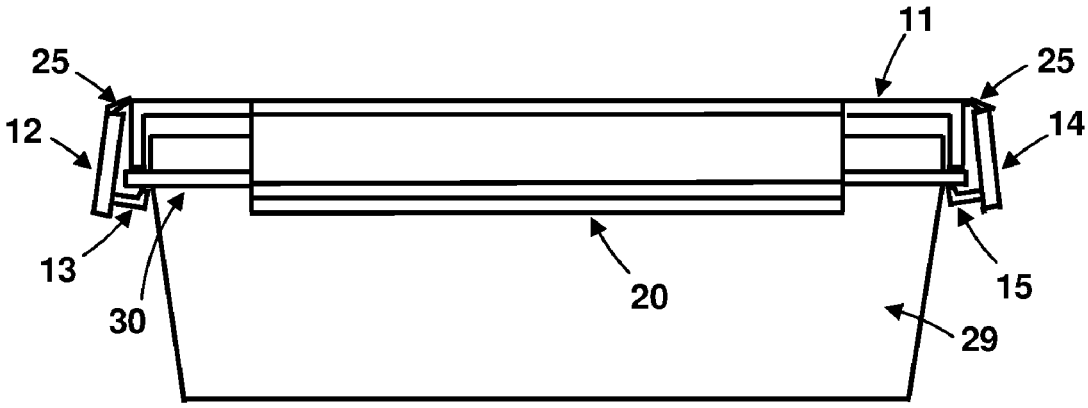
FIG. 9 is a front view of the storage container with a lid placed thereon and locked thereto.

The basic novel storage container and holder comprises three elements; a container 29 shown in and described with reference to FIG. 4, a locking lid 11 shown in and described with reference to FIGS. 1 through 3, and a holder 32 for container 29 that is shown in and described with reference to FIGS. 5 through 7. A locking lid 11 being placed on container 29 is shown in FIG. 8, and the locking lid 11 mounted on and locked to container 29 is shown in FIG. 9. How container 29 mounts in holder 32 is shown in and described with reference to FIGS. 10 and 11. Variant versions of holder 11 are shown in FIGS. 12-15 and include a locking mechanism, a universal holder, and a multi-container holder.

Storage container 29 and locking lid 11 are often made of a slightly flexible plastic which may be opaque, translucent or clear. That plastic is preferably polypropylene but may be made of other plastics or materials, such as metal. Holder 32 is also made of a tough, slightly flexible plastic which is preferably less flexible than that used to make container 29 and locking lid 11. Again it may be opaque, translucent or clear. That plastic is now preferably ABS but container 29 and holder 32 may be made of other plastics or materials, such as metal.

Figure 1:
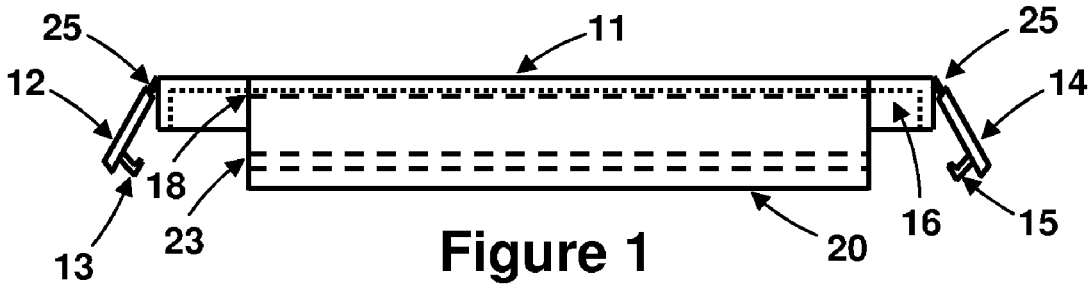
FIG. 1 is a side view of the longer dimension of a lid for a storage container.

FIG. 1 is a side view of the longer dimension of a lid 11 for a storage container 29. FIG. 2 is a side view of the shorter dimension of lid 11, and FIG. 3 is a bottom view of lid 11. To understand the makeup of lid 11 FIGS. 1, 2 and 3 should be viewed in conjunction with each other. As may be seen in FIG. 3, the version of lid 11 described herein is rectangular in shape with rounded corners, but lid 11 may be square or of many other shapes and may not have rounded corners.

FIG. 1 is a side view of the longer dimension of lid 11 for storage container 29 with the top of lid 11 facing upward. Lid 11 has a side lip around its periphery that forms a recessed area 16 that fits over the top lip 27 of container 29 (FIG. 4) when lid 11 is mounted on and locked to the top of container 29 as shown in and described with reference to FIGS. 8 and 9. Details of recessed area 16 are not shown in FIG. 1 to avoid cluttering the drawing, but the details are shown in and described with reference to FIG. 3. Fabricated as part of lid 11 are four locking tabs of which tabs 12, 14 and 20 are shown in FIG. 1 and tab 22 is shown in FIG. 2. Tabs 12, 14, 20 and 22 are all attached to the main generally rectangular top of lid 11 during manufacture of the lid by what are called "living hinges" 18 and 25. These living hinges are thinner, flexible areas of the plastic from which lid 11 is molded. Hinges 25 attach the shorter locking tabs 12 and 14 to lid 11 as shown in FIG. 1, and hinges 18 attach the longer locking tabs 20 and 22 to lid 11 as shown in FIG. 2.

Figure 2:
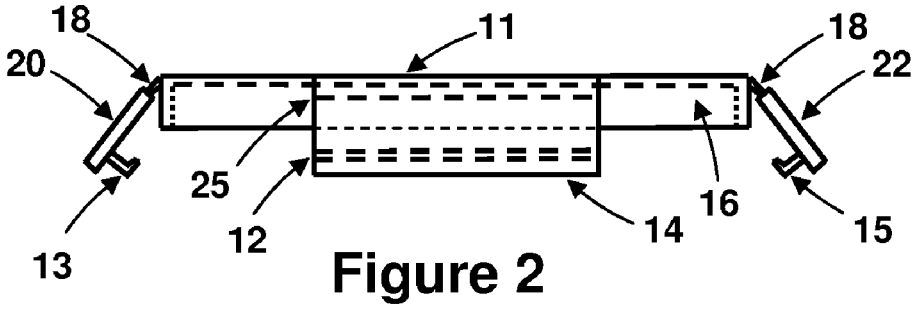
FIG. 2 is a side view of the shorter dimension of a lid for a storage container.

In FIG. 2 is shown an end view of the narrower dimension of lid 11 for storage container 29 with the top of lid 11 facing upward. Locking tabs 14, 20 and 22 are seen in this figure. Tab 22 couldn't be seen in FIG. 1 because it is behind tab 20. The rest of the description of FIG. 2 is the same as for FIG. 1 so is not repeated here.

Figure 3:
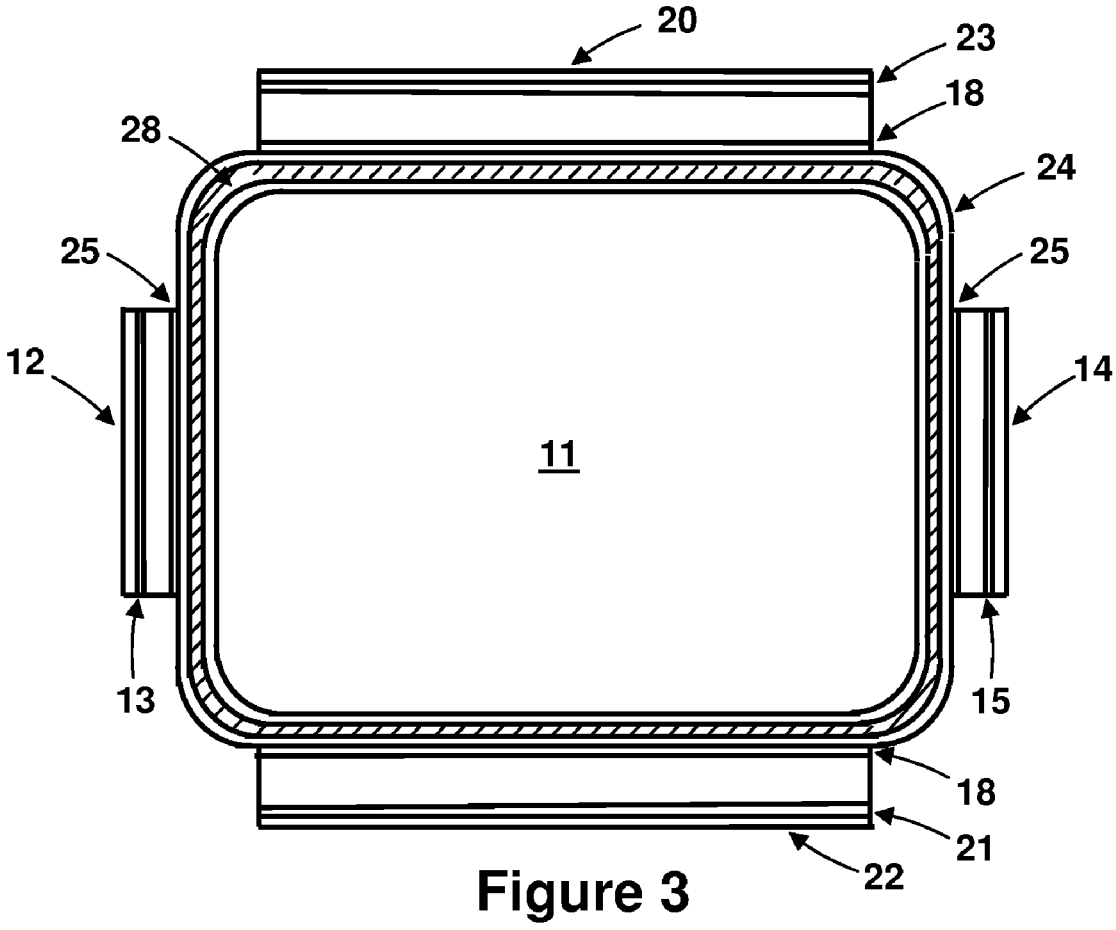
FIG. 3 is a bottom view of a lid for a storage container.

FIG. 3 shows a top view of lid 11 for storage container 29 with the bottom of lid 11 facing the viewer. The generally rectangular shape of lid 11 is best seen in this figure. There are rounded corners that facilitate inserting a container 29 with lid 11 attached into a holder 32 as described elsewhere in this detailed description. In addition, all four locking tabs 12, 14, 20 and 22 are seen in this figure. The living hinges 18 and 25 for all four locking tabs are seen. The main thing shown in this figure is the periphery area of the underside of lid 11. Around this periphery area is a groove 24 in which is positioned a flexible gasket 28. When lid 11 is placed on top of container 29, as shown in FIGS. 8 and 9, gasket 28 sits on top of the rim 27 of container 29. When the locking tabs 12, 14, 20 and 22 are locked to ridge 30 around the outside and near the top of storage container 29 (FIGS. 4 & 9) rim 27 is pressed into gasket 28 in groove 24 to create an airtight, watertight, dust-proof seal.

Figure 4:
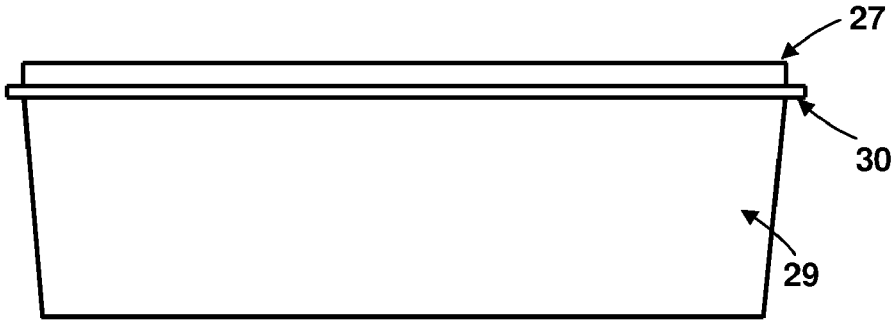
FIG. 4 is a side view of a storage container.

FIG. 4 shows side view of the longer side of storage container 29. Another figure showing the shorter side is not presented because it would look like FIG. 4 except a little narrower. The rim 27 that seats into gasket 28 on the underside of lid 11 is seen. Ridge 30 around the outside and near the top of container 29 is also seen. Ridge 30 is used to lock lid 11 to container 29 as shown in FIG. 9 and also provides rigidity to container 29.

Figure 5:
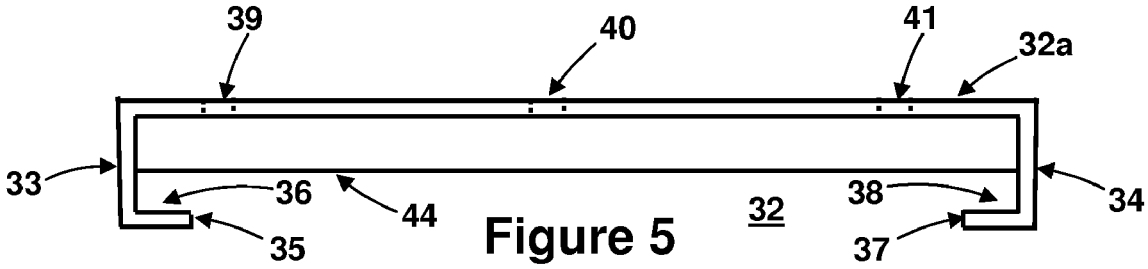
FIG. 5 is a front view of a holder for a storage container and into which a storage container is slid.
Figure 10:
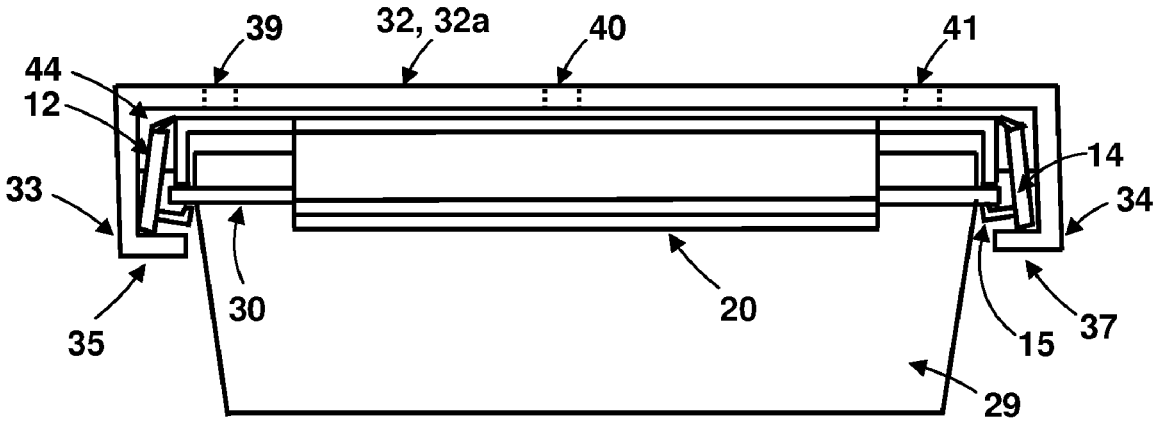
FIG. 10 is a front view of a holder with a sealed storage container inserted into and firmly held therein.
Figure 11:
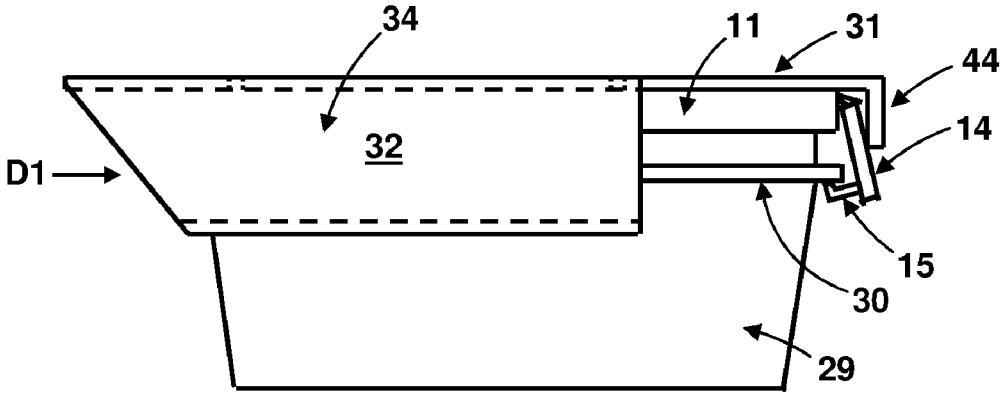

FIG. 5 is a front view of holder 32. There is top having three holes 39, 40 and 41 there through. These holes are used with screws to fasten holder to a surface, whether that surface be horizontal, sloped or vertical. Any number or screw or other fastener holes may be utilized, and any of the many fastening means or adhesives known in the art may be utilized. Holder 32 has a rear overhang 44 protruding downward which limits the travel of a storage container 29 with lid 11 thereon into holder 32. In another variation of holder 32 overhang 44 may be omitted. On the left and right side there are downwardly extending sides 33 and 34 that each have an L-shaped extension 35 or 37 that extend parallel to and underneath the top 32*a* of holder 32. These extensions 35 and 37 create shelves 36 and 38 as shown. When a storage container 29 with lid 11 locked thereon is inserted within holder 32, as shown in FIGS. 10 and 11, two opposing locking tabs 12 and 14 of lid 11 sit on top of extensions 35 and 37 as seen in FIG. 10.

Figure 6:
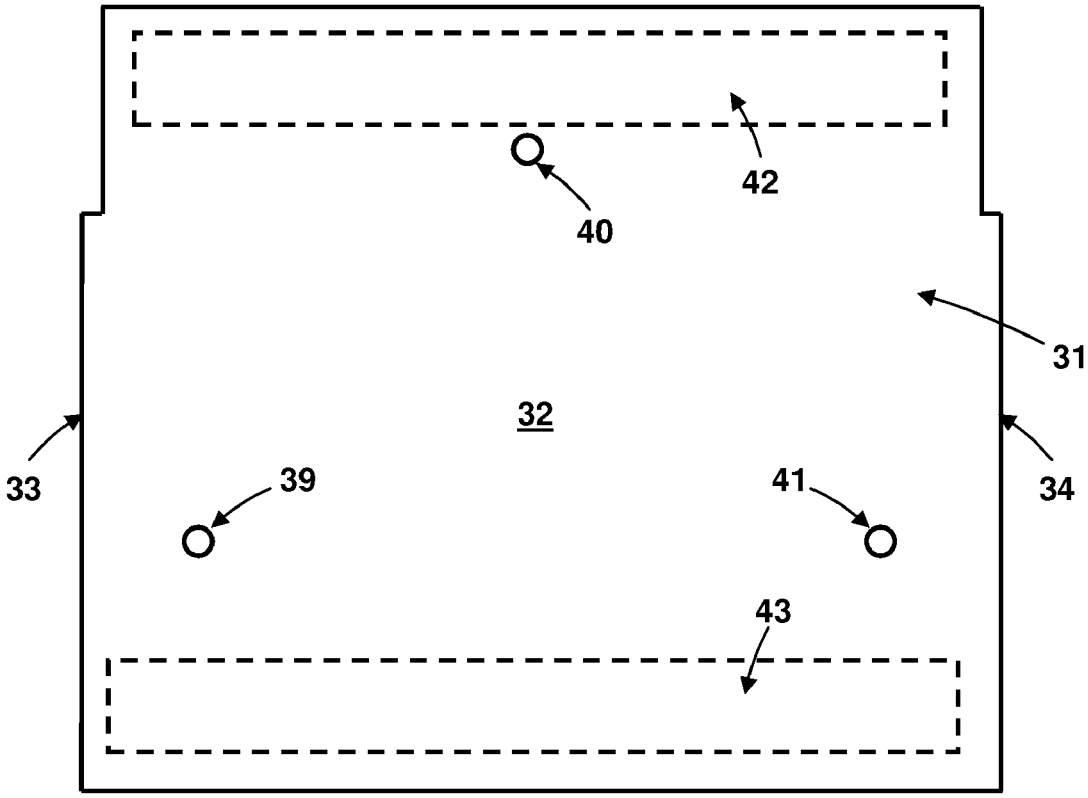
FIG. 6 is a top view of a holder.

FIG. 6 is a top view of holder 32. The screw mounting holes 39, 40 and 41 are shown that are used for fastening holder 32 to a surface. As previously mentioned any number of screws or other fastening means or adhesives may be used. As an alternative way of mounting holder 32 to a surface (not shown) self adhesive tape such as Velcro™ strips 42 and 43, 3M Very High Bond Tape, or 3M Dual Lock Tape may be adhesively attached to the top side 31 of holder 32 and a mating piece is adhesively attached to a surface to which holder 32 is to be mounted. Downwardly extending sides 33 and 34 are seen in this figure.

Figure 7:
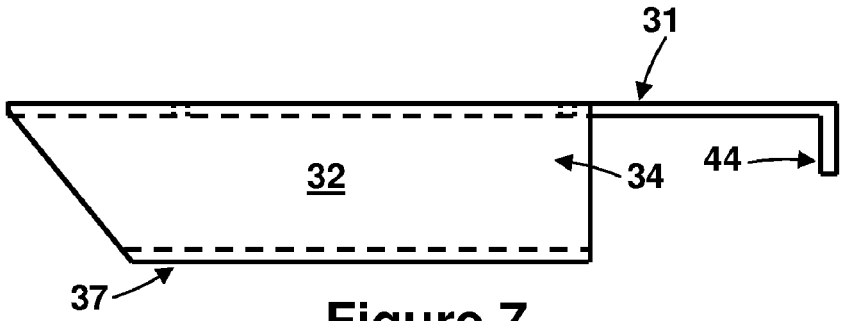
FIG. 7 is a side view of a holder.

FIG. 7 shows the right side of holder 32. The rear overhang 44 limits the travel of storage container 29 with a locking lid 11 thereon inside holder 32 as seen in FIG. 11. Downwardly extending side 34 is seen and its L-shaped extension 37 is shown as a dotted line. The front or entrance side of holder has a tapered shape as shown.

Figure 14:
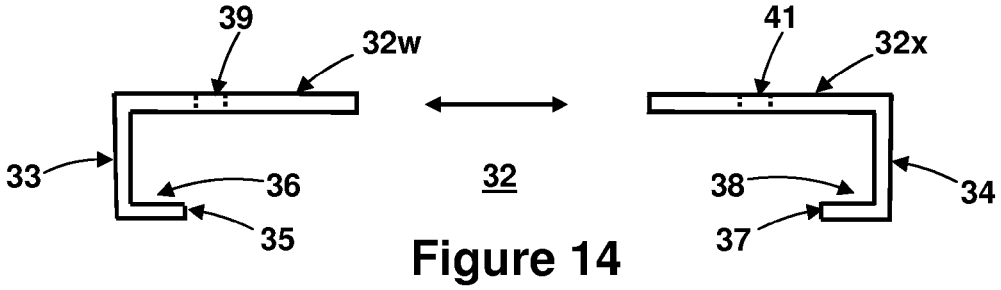
FIG. 14 is a front view of a two piece, universal holder that is adjusted while being mounting to a surface to hold storage containers of different sizes.
Figure 15:
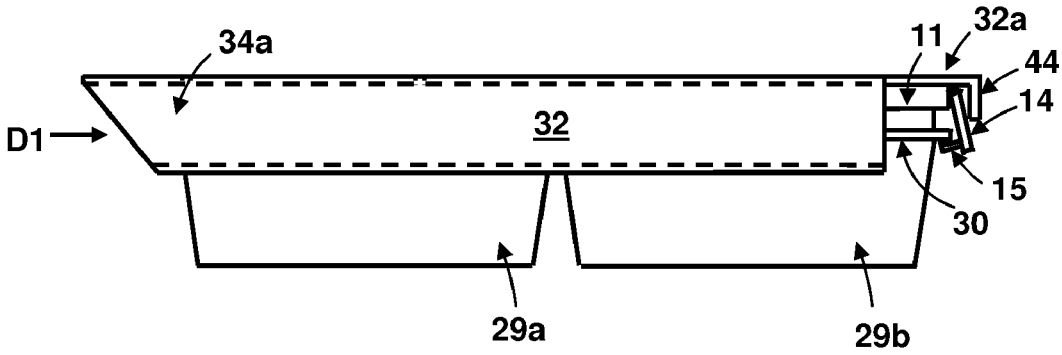
FIG. 15 is a side view of a holder that has two sealed storage containers inserted into and firmly held therein.

While FIGS. 5, 6 and 7 show container holder 32 as a single piece, in an alternative embodiment of the invention holder 32 may comprise two separate pieces 32*a* and 32*b*, as shown in FIG. 14, that are spaced during mounting to a surface in order to accommodate storage containers 29 of one selected size. In this sense a holder 32 comprised of elements 32*a* and 32*b* is a universal holder. In addition, the holder 32 shown in FIGS. 5, 6, and 7 only holds a single container 29. In another alternative embodiments of the invention holder 32 may be deep enough to hold two or more containers 29*a* and 29*b*, such as shown in FIG. 15, or one long container 29.

FIG. 8 shows a locking lid 11 moving in the direction of arrow D in the processing of being lowered on top of a storage container 29 to seal the container. The top rim 27 of storage container 29 will sit inside recess 16 when fully seated. The locking tabs 12, 14 and 20 normally extend outward at an angle, as shown, and do not interfere with the seating process.

FIG. 9 shows the locking lid 11 fully seated on top of storage container 29 with the locking tabs folded underneath ridge 30. When lid 11 is set on top of container 29 rim 27 is pushed into flexible gasket 28 (FIG. 3). Gasket 29 is deformed slightly and the tips 13 and 15 (FIG. 9) and tips 21 and 23 (FIG. 3) of the four locking tabs 12, 14, 20 and 22 are pushed underneath the underside of container ridge 30. Only the position of tabs 12 and 14 are clearly seen in FIG. 9, but tabs 20 and 22 look the same way when they are locked. The slightly compressed gasket 28 pushes back and the tabs 12, 14, 20 and 22 hold on the underside of ridge 30. All four tabs may thereafter be manually pulled away from ridge 30 of storage container 29 to release and remove lid 11.

FIG. 10 shows a front view of a storage container 29 with lid 11 locked thereon inserted fully into and held within holder 32. When fully inserted the rear side of container 29 hits rear overhang 44 of holder 32. The locking tabs 12 and 14 of lid 11 sit on the L-shaped extensions 35 and 37 to vertically support the storage container 29 in holder 32. In FIG. 3 it should be noted that locking lid 11 has rounded corners, but this may vary. As storage container 29 with lid 11 locked thereon is being inserted into holder 32 the leading edge round corners of lid 11 contact the downwardly extending sides 33 and 34 and pass between the two sides with an interference fit. In this process they may slightly deform sides 33 and 34 outward. This deformation will create a spring force back against the sides of locking tabs 12 and 14 and help retain storage container 29 within holder 32.

FIG. 11 shows a side view of a storage container 29 with lid 11 locked thereon inserted fully into and held within holder 32. When fully inserted the rear side of container 29 hits rear overhang 44 of holder 32 as shown. The rest of the description is the same as for FIG. 10 so is not repeated here. In an alternate embodiment of the invention rear overhang 44 may be omitted.

Figure 12:
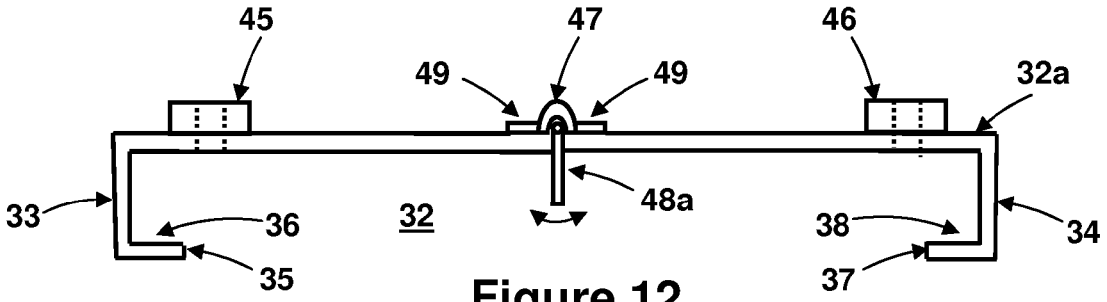
FIG. 12 is a front view of a holder having a rotatable means for locking a storage container within the holder.

FIG. 12 is a front view of a holder 32 having a rotatable lock means 47, 48*a*, 49 for locking a storage container 29 with locking lid 11 within holder 32. In this Figure there is no back stop 44 as seen in FIGS. 5 and 10. The container 29 with lid 11 is not shown in FIG. 12 but will appear the same as in FIG. 10 except for the lock means 47, 48*a*, 49. Element 47 is an elongated, inverted "U" shaped member, as shown, with horizontal extensions 49 to either side of the "U" shaped member. Members 49 are used to fasten lock means 47, 48*a* to the top 32*a* of holder 32 in one of many ways known in the art. Element 48 is an elongated swivel rod that is also "U" shaped with the elongated bottom of the "U" passing through element 47. One leg 48*a* extends down in front of holder 32 and the other leg 48*b* (not visible in this figure but visible in FIG. 13) extending down in the rear of holder 41. This is best seen in and described with reference to FIG. 13. Element 48 preferably rotates with some friction inside portion 47, but may rotate freely. When leg 48*a* is rotated to be parallel to top 32*a* of holder 32 a storage container 28 may inserted into holder 32 as shown in FIGS. 10 and 11. Leg 48*a* is then rotated to be generally perpendicular to top 32*a* to block container 28 from being removed from holder 32. Also seen in FIG. 12 are raised areas 45 and 46 through which screw holes pass for mounting holder 32. Raised areas 45 and 46 compensate for the height of the "U" shaped member 47. In cases where strips of adhesive tape are used to fasten the holder, the thickness of the tape will compensate for the height of the "U" shaped member 47. Alternatively, the thickness of top 32*a* of holder 32 may be enough to embed lock means 47, 48*a*, 49 in a groove in top 32*a*. In that case raised areas 45 and 46 are not required.

Figure 13:
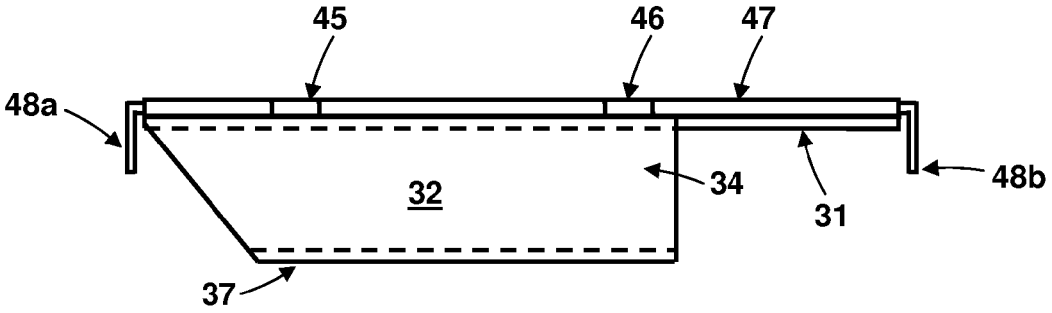
FIG. 13 is a side view of the holder having the rotatable means for locking a storage container within the holder.

FIG. 13 is a side view of holder 32 having the rotatable lock means 47, 48*a*, 49 on top 32*a* of holder 32. Both rotatable legs 48*a* and 48*b* may be seen in this Figure. If holder 32 has a rear overhang 44 the rear rotatable leg 48*b* may be omitted. The elongated portion of element 48 passes through the "U" shaped portion 47. Again, when legs 48*a* and 48*b* are rotated to be parallel to top 32*a*, a storage container 28 may be inserted into or withdrawn from within holder 32 at either end thereof. When legs 48*a* and 48*b* are rotated to be generally perpendicular to top 32*a* (other than parallel to top 32*a*), as seen in FIGS. 12 and 13, they block container 28 from being removed from either the front or rear of holder 32.

FIG. 14 is a front view of a two piece, universal holder 32 that is adjusted during mounting to hold storage containers of different sizes. The two pieces are 32*w* and 32*x* and their spacing is set during installation, as indicated by the double headed arrow, to hold storage containers 28 of a chosen width (not shown in this figure). Holder pieces 32*w* and 32*x* are fastened to a surface using screws, tapes, adhesives and in any other manner as previously described. The two piece, universal holder 32 shown in this Figure may be used with or without the rotatable lock means described in the previous paragraphs.

FIG. 15 is a side view of an alternative embodiment of holder 32. In this embodiment holder 32 is longer and may hold two or more storage containers, such as 29*a* and 29*b*, or one long container 29. The holder 32 shown in this Figure may be used with or without the rotatable lock means described with reference to FIGS. 12 and 13.

Figure 16:
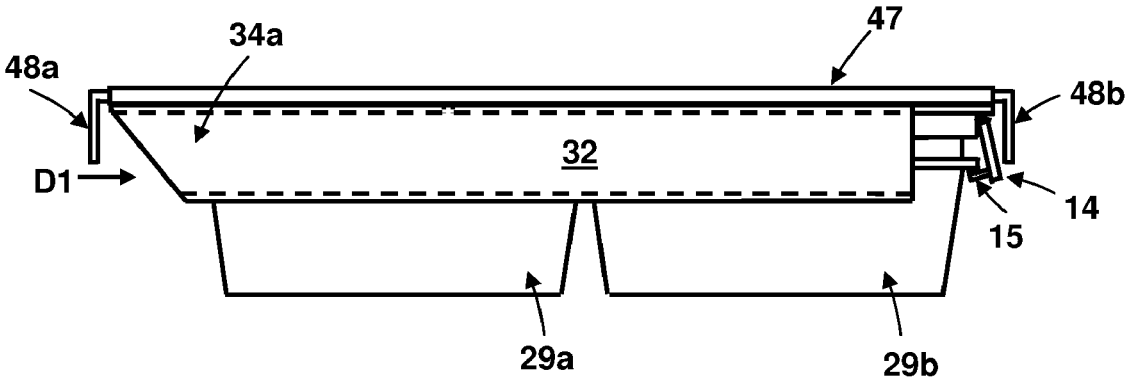
FIG. 16 is a side view of a holder that has two sealed storage containers therein and the containers are held therein by the rotatable locking means.

FIG. 16 is a side view of another alternative embodiment of the invention that is similar to that shown in FIG. 15, but the rear overhang 44 is omitted and the rotatable locking means 47, 48, 49 is added. The front view of this embodiment is alike that shown in FIG. 10 except for the addition of the rotatable locking means.

Figure 17:
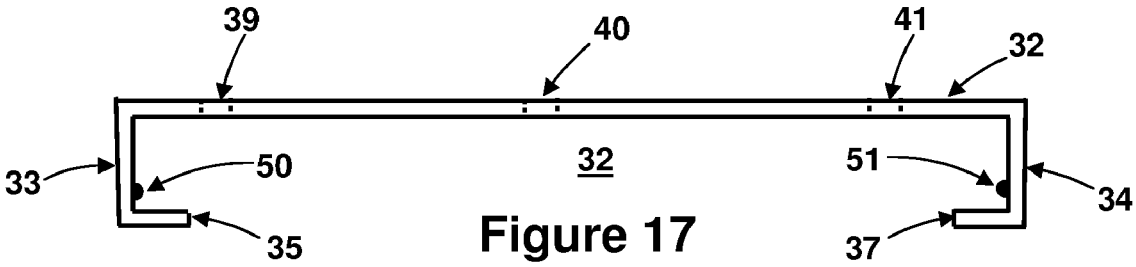
FIG. 17 is a front view of a holder wherein the side walls each have a small protrusion that help lock container(s) inside the holder.

FIG. 17 is a front view of a holder 32 wherein each of the downwardly extending sides 33 and 34 has a small protrusion 50 or 51 near the associated L-shaped extension 35 or 37 that helps lock container(s) 29 in holder 32. Locking protrusion 50 is molded as part of side 33 during manufacture and locking protrusion 51 is molded as part of side 34 during manufacture. Both locking protrusions 50 and 51 are located near the front and/or entrance of a holder 32. In FIGS. 15 and 16 this would be near the arrow marked D1. As a container 29 with a lid attached thereto is inserted into holder 32 there is an interference fit between protrusions 50 and 51 and locking tabs 12 and 14 that forces downwardly extending sides 33 and 34 outward a small amount until the container 29 passes the protrusions and is fully contained within holder 32, such as shown in FIG. 10. Any attempt to remove a container 29 from holder 32 meets with the same resistance and the downwardly extending sides 33 and 34 must be forced outward until the container 29 is fully removed from holder 32. While this simple locking arrangement is shown as small protrusions in FIG. 17 it may be either bead shaped or ridge that extends along the length of each of downwardly extending sides 33 and 34.

Figure 18:
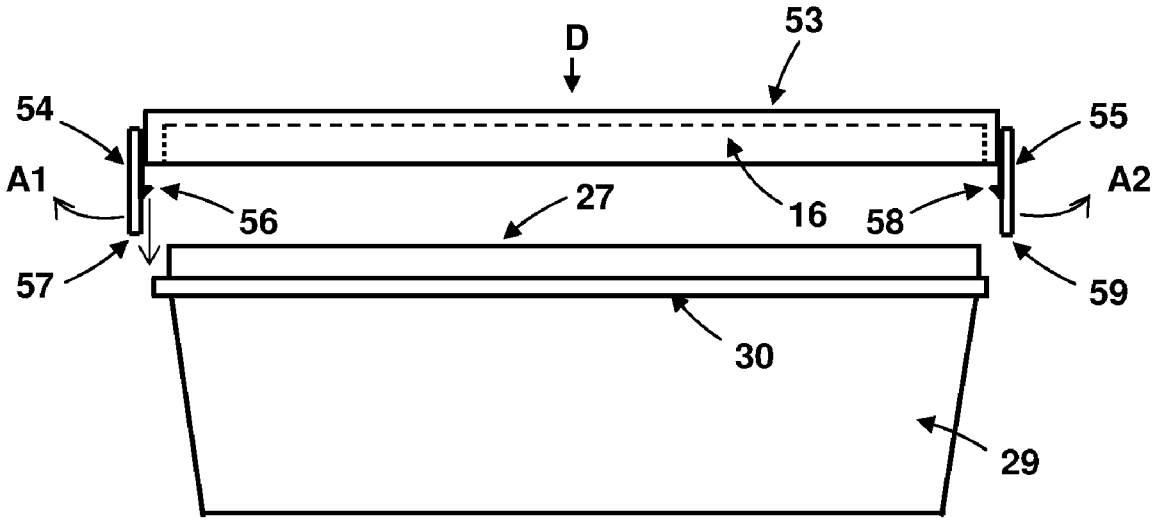
FIG. 18 is a side view of an alternative embodiment of a lid that does not have a flexible hinge as the lid is being inserted onto a storage container.

FIG. 18 is a side view of an alternative embodiment of a lid 11 that does not have a flexible hinge. Rather, the flexible nature of the material (plastic, metal or other material) from which lid 11 is made serves the same purpose as the flexible hinge. In FIG. 18 locking extensions 54 and 55 are respectively shown made as part of the left side and right side of the vertical overhang of lid 53. To avoid cluttering the drawing identical locking extension are not shown as part of the front and rear vertical overhang of lid 53. However, they may be provided and their operation is the same as described below for extensions 54 and 55. Extension 54 has an inwardly facing protrusion 56 and a longer portion 57 extending downward, and extension 55 has an inwardly facing protrusion 58 and a longer portion 59 extending downward.

As lid 53 is inserted onto the top of container 29, as indicated by the downward facing arrow adjacent to locking extension 54, lip 27 of container 29 passes inside recess 16 on the underside of lid 53. Eventually protrusion 56 on locking extension 54 comes into contact with ridge 30 around the outside of container 29 below its lip 27, and protrusion 58 on locking extension 55 also comes into contact with ridge 30. There is an interference fit between the protrusions 56 and 58 and ridge 30. As lid 53 is pushed further in the downward direction the interference fit causes locking extensions 54 and 55 to bow outward and thereby allow their protrusions 56 and 58 to pass over ridge 30. The travel of extensions 54 and 55 as they bow outward is shown as arrows A1 and A2. When lid 53 is fully inserted onto container 29 and protrusions 56 and 58 have passed over ridge 30, they move back to their original positions with reference to the top of lid 53 which is now under the bottom side of ridge 30 as shown in and described with reference to FIG. 19. This occurs as a result of the elastic nature of the plastic or other material from which lid 53 is fabricated.

Figure 19:
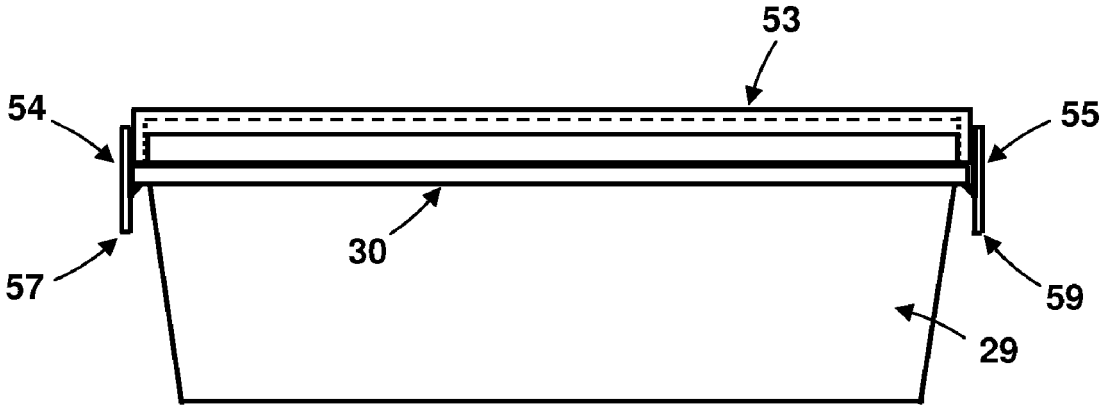
FIG. 19 is a side view of the alternative embodiment of a lid that does not have a flexible hinge after the lid has been inserted fully onto and locked to a storage container.

FIG. 19 is a side view of lid 53 after it has been inserted on and locked to storage container 29. Protrusions 56 and 58 both rest under the bottom edge of storage container 29 and thereby lock lid 53 to container 29. To unlock and remove lid 53 from container 29 the longer extensions 57 and 59 are pulled outward, away from container 29, until protrusions 56 and 58 can pass over the top of ridge 30 around the upper part of the container.

Container 29 may now be inserted into holder 32 as shown in FIGS. 10 and 11. When container 29 with lid 53 locked thereto is inserted into holder 32 the bottom edge of the lower extensions 57 and 59 rest on the L-shaped extensions 35 and 37 as shown in FIG. 10 for the locking tabs 12 and 14. In this position the rotatable lock means 47, 48, 49 may be utilized as shown in FIG. 16. In addition, the locking protrusions 50 and 51 may be utilized in lieu of rotatable lock means 47, 48, 49.

While what is described herein is the preferred embodiment of the invention, numerous changes may be made without departing from the spirit and scope of the invention. For example, the rotatable locking means disclosed herein may be changed to any other type of locking means. Further, while the holders disclosed herein hold one or more storage containers in a row fashion, the holders may be made wider with vertical pieces attached to the top surface of the holder and having T-shaped extensions at their bottom to permit holding two or more side by side rows of containers.

What is claimed is:

1. A storage container holder for holding a storage container, the holder comprising:

a storage container having an open top with a rim and a raised protrusion on the outside of the container, and the protrusion has a bottom edge furthest from the rim;

a lid that is placed on the rim of the open top of the container to seal the container, the lid having an edge to which are flexibly attached a plurality of locking tabs that extend outward from the lid;

wherein when the lid is placed on the rim of the open top of the container the locking tabs are pushed toward the storage container and the locking tabs pass under bottom edge of the raised protrusion to lock the lid to the storage container; and a holder with a top having sides fastened thereto that extend away from the top at an angle, some of the sides having an L-shaped extension extending from the sides furthest from the top of the holder, and the extensions are generally parallel to the top of the holder and extend toward each other;

wherein when the storage container with lid locked thereto is inserted between the sides of the holder the locking tabs of the lid sit on the L-shaped extensions of the sides of the holder; and wherein sides of the holder contact two opposing sides of the container with locked lid thereon when the container with locked lid is inserted into the holder, and this contact is an interference fit that deforms the holder sides away from the container, maintains the lid being locked on the container and thereby helps retain the container with locked lid within the holder.

2. The storage container holder of claim 1 wherein the raised protrusion of the storage container extends all the way around the outside of the container.

3. The storage container holder of claim 1 wherein the holder further comprises a stop means that limits how far a storage container with locked lid can be inserted into the holder.

4. The storage container holder of claim 1 wherein when the holder is deep enough to permit more than one storage container with locked lid to be inserted into the holder.

5. A storage container holder for holding a storage container that has an open top with a rim and a raised protrusion on the outside of the container, and the protrusion has a bottom edge furthest from the rim, the storage container having an open top with a rim and a raised protrusion on the outside of the container, and the protrusion has a bottom edge furthest from the rim, the container having a lid around the edges of which are flexibly attached a plurality of locking tabs that extend outward from the lid, and when the lid is placed on the rim of the open top of the container the locking tabs are pushed toward the storage container and the locking tabs pass under bottom edge of the raised protrusion to lock the lid to the storage container, the holder comprising:

a top having sides fastened thereto that extend away from the top at an angle, some of the sides having an L-shaped extension extending from the sides, and the L-shaped extensions are generally parallel to the top of the holder and extend toward each other;

wherein the storage container with lid locked thereto is inserted between the sides of the holder the locking tabs of the lid sit on the L-shaped extensions of the sides of the holder, and the locking tabs are in contact with the sides of the holder in an interference fit that deforms the holder sides away from the container and thereby helps retain the container with locked lid within the holder; and wherein the holder is deep enough to permit more than one storage container with locked lid to be inserted into the holder.

* * * * *